US009934772B1

(12) United States Patent
Yoelin

(10) Patent No.: US 9,934,772 B1
(45) Date of Patent: Apr. 3, 2018

(54) SELF-PRODUCED MUSIC

(71) Applicant: Louis Yoelin, La Grange Park, IL (US)

(72) Inventor: Louis Yoelin, La Grange Park, IL (US)

( * ) Notice: Subject to any disclaimer, the term of this patent is extended or adjusted under 35 U.S.C. 154(b) by 0 days.

(21) Appl. No.: 15/658,856

(22) Filed: Jul. 25, 2017

(51) Int. Cl.
*G10H 1/36* (2006.01)
*G10H 1/00* (2006.01)

(52) U.S. Cl.
CPC ..... *G10H 1/366* (2013.01); *G10H 1/0033* (2013.01); *G10H 2210/281* (2013.01); *G10H 2210/331* (2013.01); *G10H 2240/016* (2013.01); *G10H 2240/161* (2013.01)

(58) Field of Classification Search
CPC ..... G10H 1/0025; G10H 2240/145; G10H 1/365; G10H 2240/325; G10H 1/0058; G10H 7/00; G10K 11/341
See application file for complete search history.

(56) References Cited

U.S. PATENT DOCUMENTS 7,542,815 B1 6/2009 Berchin
7,765,019 B2 * 7/2010 Sinai ..... G06F 3/162 379/428.02
8,086,334 B2 12/2011 Berchin
8,446,947 B2 * 5/2013 Yu ..... G10L 19/24 341/50
8,600,533 B2 12/2013 Berchin
8,868,411 B2 * 10/2014 Cook ..... G10H 1/366 704/207
9,058,797 B2 * 6/2015 Salazar ..... G10H 1/366
9,852,742 B2 * 12/2017 Cook ..... G10L 21/013
2002/0177994 A1 11/2002 Chang et al.
2005/0131562 A1 * 6/2005 Kang ..... H04M 19/04 700/94
2005/0163322 A1 * 7/2005 Kang ..... H04S 1/002 381/17
2009/0107320 A1 4/2009 Willacy et al.
2009/0158918 A1 * 6/2009 Norman ..... G11C 5/02 84/603
2010/0017205 A1 * 1/2010 Visser ..... G10L 19/00 704/225
2011/0116642 A1 * 5/2011 Hall ..... H04H 60/04 381/58
2011/0144982 A1 6/2011 Salazar et al.
2011/0144983 A1 6/2011 Salazar et al.
2011/0251840 A1 10/2011 Cook
2012/0089390 A1 4/2012 Yang et al.
(Continued)

OTHER PUBLICATIONS

Smule Sing!, a web page located at http://www.smule.com/apps, downloaded on Jul. 25, 2017.
(Continued)

*Primary Examiner* — Marlon Fletcher
(74) *Attorney, Agent, or Firm* — Richard Baker

(57) ABSTRACT

An application for operating on a smart phone that records a musician's performance, either voice or instrumental, in combination with pre-recorded music. The combination allows for the auto tuning of the recording, the compression of the recording, the equalization of the recording, adding in reverb, and the audio quantization of the rhythm. Once combined, the song is transmitted to social media and/or to an online store for sale. The user can also make a video with the song. Additional marketing such as song competitions or music reviews and ratings are also provided.

20 Claims, 16 Drawing Sheets

(56) References Cited

U.S. PATENT DOCUMENTS

| | | | | |
|---|---|---|---|---|
| 2013/0208903 | A1* | 8/2013 | Ojala | H04R 29/00 381/23 |
| 2014/0229831 | A1 | 8/2014 | Chordia et al. | |
| 2014/0355789 | A1* | 12/2014 | Bohrarper | H04R 3/00 381/119 |
| 2015/0296288 | A1* | 10/2015 | Anastas | H04R 1/1041 381/77 |
| 2016/0019900 | A1* | 1/2016 | Vasilache | G10L 19/038 381/23 |
| 2017/0076738 | A1* | 3/2017 | Freudenthal | G10L 21/0388 |
| 2017/0124999 | A1 | 5/2017 | Hersh et al. | |

OTHER PUBLICATIONS

About musical.ly, a web page located at https://musical.ly/en-US/about, downloaded on Jul. 25, 2017.

The Voice, a web page located at https://www.nbc.com/the-voice/exclusives/app-s12, downloaded on Jul. 25, 2017.

Music Maker JAM, a web page located at https://play.google.com/store/apps/details?id=com.magix.android.mmjam&hl=en, downloaded on Jul. 25, 2017.

Record you music, sign—nana, a web page located at https://play.google.com/store/apps/details?id=com.nanamusic.android&hl=en, downloaded on Jul. 25, 2017.

Acapella from PicPlayPost, a web page located at https://play.google.com/store/apps/details?id=co.mixcord.acapella&hl=en, downloaded on Jul. 25, 2017.

Rapchat: Social Rap Maker, Recording Studio, Beats, a web page located at https://play.google.com/store/apps/details?id=me.rapchat.rapchat&hl=en, downloaded on Jul. 25, 2017.

* cited by examiner

Screen 1-sign in screen
(first time user)

Instantly has influencer/users videos in background.
Sign up with:
Facebook,
Snapchat
Or sign up with email (next screen has first name, last name, age)
Popstar (handle) name:
Signing up you agree to terms.

Figure 5

Screen 2-Choose song style

Still has influencer/user videos in background. Choose song style: 1. EDM Dance Pop 2. Indie 3. Rap 4. Country 5. Garage Rock.
Has options for "fans" (non music makers/artists) to vote in competition section, and see friend's profiles and competitions. Signing in with Snapchat or Facebook instantly imports friend's users data.

Figure 6

Screen 3-Choose song

Edm Dance Pop

Choose song: 1. Song Name 1 2. Song Name 2 3. Song Name 3 4. Song Name 4. 5. Song Name 5.

Not sure what should be in background. Maybe a picture that looks like you're in a recording studio. To give UX feel like user's in a studio.

Figure 7

Screen 4-Learn song

Song Name 1

Song player with play button. Looks/works similar to "voice memo" app on iphone. Can rewind or fastforward in the song by swiping to the left and right on wave file of song. Karaoke-like screen with lyrics below the player screen, runs in sync with player screen for user to learn the song. "Record button" either on the player or bottom of screen .

Figure 8

Screen 5-Record

Song Name 1

Same player as screen 4, but with record button. Player/recorder will function very similar to the "voice memo" app on iphone. Review "voice memo" to see how it functions, and how user can rewind, fast forward, and re-record onto previous recordings. Karaoke-like screen in similar position as screen 4. Screen 4 and 5 will look very similar. "Finish" big button on buttom of screen.

Figure 9

Screen 6-Processing (mixing)

When the user finishes recording, he hits the "finish" button. The app will then process (mix) the vocals onto the song, using preset settings per song with the audio softwares: auto-tune, delay, reverb, eq, compression, audio quanization. This doesn't have to be a separate screen from screen 5. If you can process the vocals into the song while in screen 5, that would be simpler for the user.

Figure 10

Screen 7-Finished!

"Song Name" by Bob Bell . The song is finished and the user can listen to the song. He can always go back to screen 5 and make changes. I want the user to feel like he's now an original pop star. Perhaps background will look like he's on stage with big crowd in front of him. He can then: 1. Sell the song 2. Compete with the song against other users. 3. Make a video just like how Musical.ly app works 4. Compete with music video 5. Enter a "shop" section where he can buy swag, merchandise, sign up for an OpPop weekend workshop.

Figure 11

Screen 8-Sell, compete

Selling-App will link in all user's social networks: Snapchat, Facebook, Instagram, WeChat, Twitch, Whatsapp, Twitter, Pinterest, Periscope, Line, etc., plus contacts from phone. User can send everyone a link to a :30 sample of the song. Anyone can then download the full song for $.99. User directly gets % of sales.

Compete-Competition section will function similar to video game competitions with seasons, achievements, etc.

Video-User can make video with song similar to Musical.ly's video effects, editing, and filters, and compete with that.

Shop-User can buy OpPop merchandise/swag (clothes), usb microphone, sign up for a workshop, etc.

Figure 12

SELF-PRODUCED MUSIC

BACKGROUND

Technical Field

The devices described herein are directed to musical recording, and more specifically to self-recording and producing songs based on pre-recorded media.

Description of the Related Art

Ever since the beginning of electronic recording of music, musicians have sung songs to recorded music. In some countries, karaoke is a popular evening entertainment activity, with singers singing alone with recorded musical instruments. In its simplest form, the song is sung without electronic assistance. As recording technology improved, karaoke was sung into a microphone, and electronically mixed with the pre-recorded music. The next advancement was to maintain a recording of the mixed vocals and instruments.

Today we have a number of apps and tools for mixing musical tracks into a digital recording. For example, a digital audio workstation or DAW is an electronic device or computer software application for recording, editing and producing audio files such as songs, musical pieces, human speech or sound effects. DAWs come in a wide variety of configurations from a single software program on a laptop, to an integrated stand-alone unit, all the way to a highly complex configuration of numerous components controlled by a central computer. Regardless of configuration, modern DAWs have a central interface that allows the user to alter and mix multiple recordings and tracks into a final produced piece. DAWs are used for the production and recording of music, radio, television, podcasts, multimedia and nearly any other situation where complex recorded audio is needed.

Computer-based DAWs have extensive recording, editing, and playback capabilities (some even have video-related features). For example, musically, they can provide a near-infinite increase in additional tracks to record on, polyphony, and virtual synthesizer or sample-based instruments to use for recording music. A DAW with a sampled string section emulator can be used to add string accompaniment "pads" to a pop song. DAWs can also provide a wide variety of effects, such as reverb, to enhance or change the sounds themselves.

Simple smartphone-based DAWs, called Mobile Audio Workstation (MAWs), are used (for example) by journalists for recording and editing on location. Many are sold on app stores such as the iOS App Store or Google Play.

As software systems, DAWs are designed with many user interfaces, but generally they are based on a multitrack tape recorder metaphor, making it easier for recording engineers and musicians already familiar with using tape recorders to become familiar with the new systems. Therefore, computer-based DAWs tend to have a standard layout that includes transport controls (play, rewind, record, etc.), track controls and a mixer, and a waveform display. Single-track DAWs display only one (mono or stereo form) track at a time. The term "track" is still used with DAWs, even though there is no physical track as there was in the era of tape-based recording.

Multitrack DAWs support operations on multiple tracks at once. Like a mixing console, each track typically has controls that allow the user to adjust the overall volume, equalization and stereo balance (pan) of the sound on each track. In a traditional recording studio additional rackmount processing gear is physically plugged into the audio signal path to add reverb, compression, etc. However, a DAW can also route in software or use software plugins (or VSTs) to process the sound on a track.

Perhaps the most significant feature available from a DAW that is not available in analog recording is the ability to 'undo' a previous action, using a command similar to that of the "undo" button in word processing software. Undo makes it much easier to avoid accidentally permanently erasing or recording over a previous recording. If a mistake or unwanted change is made, the undo command is used to conveniently revert the changed data to a previous state. Cut, Copy, Paste, and Undo are familiar and common computer commands and they are usually available in DAWs in some form. More common functions include the modifications of several factors concerning a sound. These include wave shape, pitch, tempo, and filtering.

Commonly DAWs feature some form of automation, often performed through "envelopes". Envelopes are procedural line segment-based or curve-based interactive graphs. The lines and curves of the automation graph are joined by or comprise adjustable points. By creating and adjusting multiple points along a waveform or control events, the user can specify parameters of the output over time (e.g., volume or pan). Automation data may also be directly derived from human gestures recorded by a control surface or controller. MIDI is a common data protocol used for transferring such gestures to the DAW.

MIDI recording, editing, and playback is increasingly incorporated into modern DAWs of all types, as is synchronization with other audio and/or video tools.

There are countless software plugins for DAW software, each one coming with its own unique functionality, thus expanding the overall variety of sounds and manipulations that are possible. Some of the functions of these plugins include digital effects units which can modify a signal with distortion, resonators, equalizers, synthesizers, compressors, chorus, virtual amp, limiter, phaser, and flangers. Each have their own form of manipulating the soundwaves, tone, pitch, and speed of a simple sound and transform it into something different. To achieve an even more distinctive sound, multiple plugins can be used in layers, and further automated to manipulate the original sounds and mold it into a completely new sample.

US Patent Publication 2002/0177994 discusses one such software plugin to adjust the pitch. The plugin identifies an initial set of pitch period candidates using a first estimation algorithm, filtering the initial set of candidates and passing the filtered candidates through a second, more accurate pitch estimation algorithm to generate a final set of pitch period candidates from which the most likely pitch value is selected.

Similarly, US Patent Publication 2011/0351840 teaches a pitch correction algorithm. performances can be pitch-corrected in real-time at a portable computing device (such as a mobile phone, personal digital assistant, laptop computer, notebook computer, pad-type computer or netbook) in accord with pitch correction settings. In some cases, pitch correction settings include a score-coded melody and/or harmonies supplied with, or for association with, the lyrics and backing tracks. Harmonies notes or chords may be coded as explicit targets or relative to the score coded melody or even actual pitches sounded by a vocalist.

US Patent Publication 2009/0107320 discusses another software plugin to remix personal music. This patent teaches a personal music mixing system with an embodiment providing beats and vocals configured using a web browser and musical compositions generated from said beats and vocals. Said embodiment provides a plurality of beats and vocals that a user may suitably mix to create a new musical composition and make such composition available for future playback by the user or by others. In some embodiments, the user advantageously may hear a sample musical composition having beats and vocals with particular user-configured parameter settings and may adjust said settings until the user deems the musical composition complete.

Other plugins adjust the reverb and the equalization, as well as adjustments to treble and bass.

Audio quantization is another form of plugin that transforms performed musical notes, which may have some imprecision due to expressive performance, to an underlying musical representation that eliminates this imprecision. The process results in notes being set on beats and on exact fractions of beats. The most difficult problem in quantization is determining which rhythmic fluctuations are imprecise or expressive (and should be removed by the quantization process) and which should be represented in the output score. A frequent application of quantization in this context lies within MIDI application software or hardware. MIDI sequencers typically include quantization in their manifest of edit commands. In this case, the dimensions of this timing grid are set beforehand. When one instructs the music application to quantize a certain group of MIDI notes in a song, the program moves each note to the closest point on the timing grid.

The purpose of quantization in music processing is to provide a more beat-accurate timing of sounds. Quantization is frequently applied to a record of MIDI notes created by the use of a musical keyboard or drum machine. Quantization in MIDI is usually applied to Note On messages and sometimes Note Off messages; some digital audio workstations shift the entire note by moving both messages together. Sometimes quantization is applied in terms of a percentage, to partially align the notes to a certain beat. Using a percentage of quantization allows for the subtle preservation of some natural human timing nuances.

In recent years audio quantization has come into play, with the plug in Beat Detective on all versions of Pro Tools being used regularly on modern day records to tighten the playing of drums, guitar, bass, and other instruments.

However, none of these features adjust the rhythm of the mixed music. Nor do any of these features incorporate a complete production of a musical piece from pre-recorded instrumentals in a way simple enough for one untrained in sound production yet able to create radio quality music on a mobile device. Furthermore, none of the present art provides a mechanism for automatically converting the musical piece into an online store complete with marketing and sales functionalities.

The present invention, eliminates the issues articulated above as well as other issues with the currently known products.

SUMMARY OF THE INVENTION

An apparatus for self-producing musical piece is described that includes a microphone, an audio signal device, which could be headphones or one or more speakers, a memory, an audio codec, a network communications device, and a CPU. The audio codec is electronically connected to a microphone and an audio signal device on one side and a CPU on the other, where in the audio codec is configured to transmit first audio signals (which could be tracks of a song) to the audio signal device and to receive second audio signals from the microphone. The memory stores data and digital representations of the first and the second audio signals. The network communications device, that includes a cellular network interface, transmits and receives data, including the digital representation of the first audio signals, from a wireless network. The CPU is electrically connected to the memory, the audio codec, and the network communications device. The CPU transmits the digital representations of the first audio signals to the audio codec and receives the digital representation of the second audio signals from the audio codec, and combines the first and the second audio signals into a third audio signals by executing, in parallel, algorithms to mix, auto-tune, equalize, reverb, delay, compress and audio quantize the first and the second audio signals using preset parameters, wherein the third audio signal is stored in the memory. The third audio signals are incorporated into the musical piece.

In some embodiments the third audio signal is transmitted to the wireless network through the network communications device. The preset parameters could include a fidelity parameter that is used by a plurality of the algorithms. The CPU could be made of a plurality of processing cores, and the parallel execution of the algorithms could be performed by the plurality of processing cores. Or the parallel execution of the algorithms could be performed as different processes on a single core of the central processing device. In a third embodiment, a portion of the processing of the algorithms is executed within the audio codec.

A method for self-producing a musical piece, including the steps of receiving, in a memory attached to a central processing device, a first audio signal from a wireless network through a network communications interface; transmitting, from the memory, the first audio signal through an audio codec to an audio signal device; receiving, at the audio codec, a second audio signal from a microphone; and storing the second audio signal into the memory. The steps further include mixing, auto-tuning, equalizing, reverb/delaying, compressing and audio quantizing the first and second audio signals by the central processing device in parallel using pre-set parameters into a third audio signal, (stored in the memory) where the third audio signal is a portion of the musical piece.

The audio signal device could be a headphone or one or more speakers. The method could further include transmitting the third audio signal through the network communications interface to the wireless network. The preset parameters could include a fidelity parameter. The CPU could be made of a plurality of processing cores, and the parallel execution of the algorithms could be performed by the plurality of processing cores. Or the parallel execution of the algorithms could be performed as different processes on a single core of the central processing device. In a third embodiment, a portion of the processing of the algorithms is executed within the audio codec. The first audio signal comprises a plurality of tracks of a song.

BRIEF DESCRIPTION OF FIGURES

FIG. 5 is a description of the login screen.

FIG. 6 is a description of the chose song style screen.

FIG. 7 is a description of the chose song screen.

FIG. 8 is a description of the learn song screen.

FIG. 9 is a description of the record screen.

FIG. 10 is a description of post recording processing.

FIG. 11 is a description of the finished screen.

FIG. 12 is a description of the sell functionality.

DETAILED DESCRIPTION OF THE INVENTION

A system for the production of a musical piece is described. The system includes a smart phone with specialized hardware for processing sounds. The system includes software for accessing a library of sound tracks, for editing the tracks, for playing the sound tracks, recording new tracks, and for finishing the musical piece. The finishing may include auto tuning, adding reverb features, compression, equalizing the sound, and audio quantization. The system further includes taking the finished musical piece, creating a short marketing sample of the musical piece, uploading both the marketing sample and the complete musical piece to an online music store. The online music store includes features for pushing the sample to various social media platforms to advertise the musical piece and an online storefront for selling the musical piece.

Hardware Description

Figure 1:
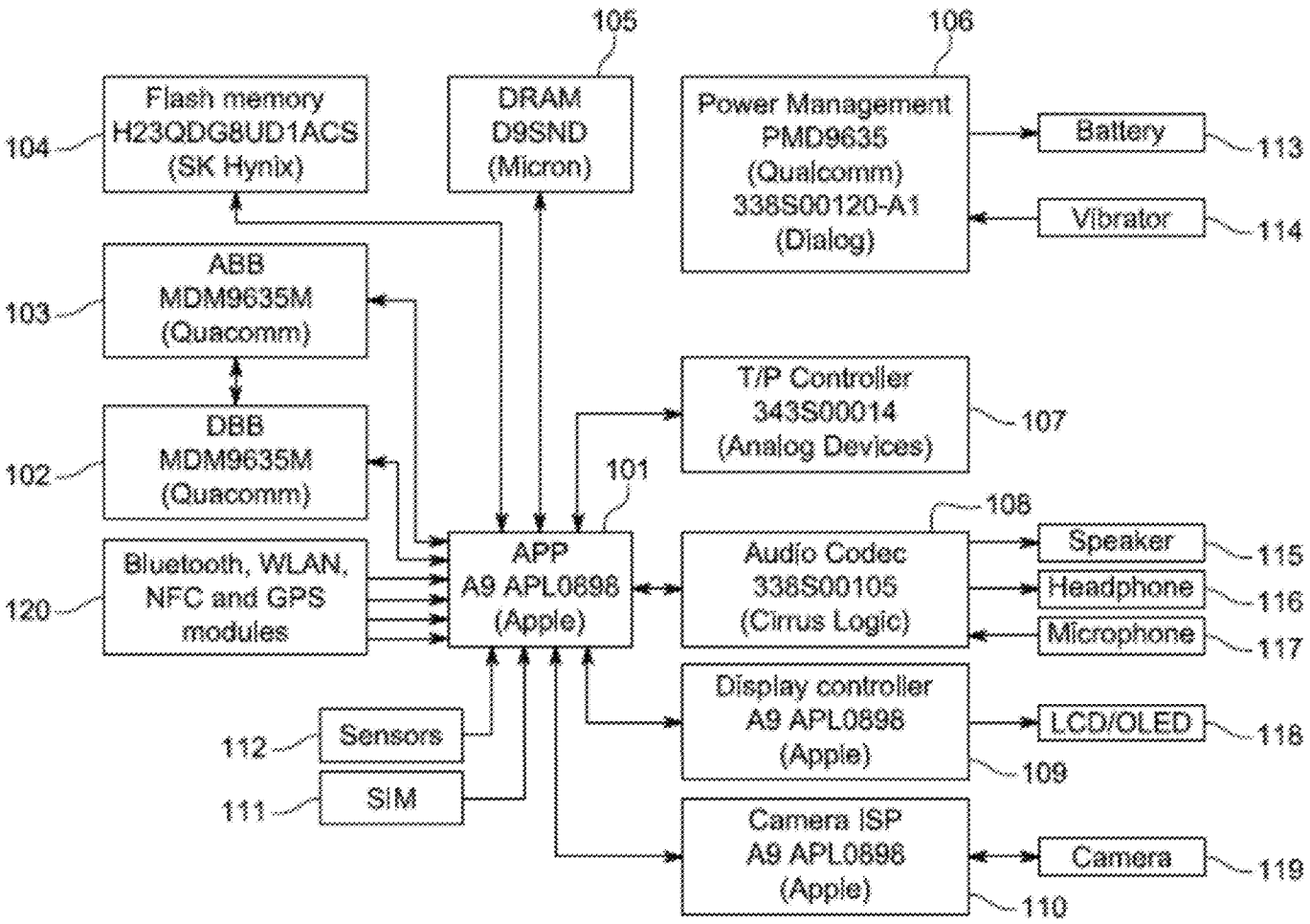
FIG. 1 is a functional block diagram of a smartphone.

FIG. 1 shows the electrical functional diagram of an Apple smartphone, called the iPhone 6S, and show the data flow between the various functional blocks. The iPhone is one embodiment of this hardware. Other smartphones are used in other embodiments. The center of the functional diagram is the Apple A9 64-bit system on a chip 101. The A9 101 features a 64-bit 1.85 GHz ARMv8-A dual-core CPU. The A9 101 in the iPhone 6S has 2 GB of LPDDR4 RAM included in the package. The A9 101 has a per-core L1 cache of 64 KB for data and 64 KB for instructions, an L2 cache of 3 MB shared by both CPU cores, and a 4 MB L3 cache that services the entire System on a Chip and acts as a victim cache.

The A9 101 includes an image processor with temporal and spatial noise reduction as well as local tone mapping. The A9 101 directly integrates an embedded M9 motion coprocessor. In addition to servicing the accelerometer, gyroscope, compass, and barometer 112, the M9 coprocessor can recognize Siri voice commands. The A9 101 is also connected to the SIM card 111 for retrieving subscriber identification information.

The A9 101 interfaces to a two chip subsystem that handles the cellular communications 102, 103. These chips 102, 103 interface to LTE, WCDMA, and GSM chips that connect to the cellular antenna through power amps. These chips 102, 103 provide the iPhone with voice and data connectivity through a cellular network.

In addition to the on chip memory of the A9 101, the A9 101 connects to flash memory 104 and DRAM 105 for additional storage of data.

Electrically connected, through the power supply lines and grounds, to the A9 101 and the rest of the chips 102-119 is the power management module 106. This module 106 is also connected via a data channel to the A9 101. The power management module 106 is connected to the battery 113 and the vibrator 114.

The Touch Screen interface controller 107 is connected to the A9 101 CPU. The Touch Screen controller also interfaces to the touch screen of the iPhone.

The Audio codec 108 in the iPhone is connected to the A9 101 and provides audio processing for the iPhone. The Audio codec 108 is also connected to the speaker 115, the headphone jack 116, and the microphone 117. The Audio codec 108 provides a high dynamic range, stereo DAC for audio playback and a mono high dynamic range ADC for audio capture. The Audio codec 108 may feature high performance up to 24-bit audio for ADC and DAC audio playback and capture functions and for the S/PDIF transmitter. The Audio codec 108 architecture may include bypassable SRCs and a bypassable, three-band, 32-bit parametric equalizer that allows processing of digital audio data. A digital mixer may be used to mix the ADC or serial ports to the DACs. There may be independent attenuation on each mixer input. The processing along the output paths from the ADC or serial port to the two stereo DACs may include volume adjustment and mute control. One embodiment of the Audio codec 108 features a mono equalizer, a sidetone mix, a MIPI SoundWire or $I^2S$/TDM audio interface, audio sample rate converters, a S/PDIF transmitter, a fractional-N PLL, and integrated power management. In some audio codecs, digital signal processing and fast Fourier transformation functionality is available, either integrated into the sound processing or available to the CPU 101 for offloading processing from the CPU.

The A9 101 chip also interfaces to a Camera integrated signal processor 110 chip, the Camera chip 110 connected to the camera 119.

There is also a Display Controller 109 that provides the interface between the A9 101 chip and the LCD (or OLED) screen 118 on the iPhone.

The wireless subsystem 120 provides connectivity to Bluetooth, WLAN, NFC and GPS modules. This handles all of the non-cellular communications to the Internet and to specific devices. The Bluetooth devices could include a variety of microphones, headsets, and speakers. The wireless subsystem 120 interfaces with the A9 101 chip.

In addition to a smartphone, the present invention utilizes a server system to perform electronic commerce, sales, and marketing. This server is connected to one or more smartphones over the Internet.

The server is a specialized computer system designed and tuned to process web traffic efficiently and rapidly. The server has a central processing unit, a storage subsystem and a communications subsystem. The communications system, in one embodiment, is a high performance network interface chip or card for connecting the server central processing unit to an Ethernet network. It could use a fiber optic connection or a copper Gigabit Ethernet (or more, although the use of 10 Base T or 100 Base T would also be another embodiment). Multiple network connections could be used for redundancy, load balancing, or increased bandwidth. The storage subsystem could include any number of storage technologies, such as STAT, SAS, RAID, iSCSI, or NAS. Storage could be on solid state drives, rotating hard drives, CD Roms, or other technologies. Central processing units could be any number of high performance processors, such as those from Intel, AMD, or Motorola. In some embodiments, the server could integrate the CPU with the network functionality in a system on a chip architecture.

Large servers need to be run for long periods without interruption. Availability requirements are very high, making hardware reliability and durability extremely important. Enterprise servers need to be very fault tolerant and use specialized hardware with low failure rates in order to maximize uptime. Uninterruptible power supplies might be incorporated to insure against power failure. Servers typically include hardware redundancy such as dual power supplies, RAID disk systems, and ECC memory, along with extensive pre-boot memory testing and verification. Critical components might be hot swappable, allowing technicians to replace them on the running server without shutting it down, and to guard against overheating, servers might have more powerful fans or use water cooling. They will often be able to be configured, powered up and down or rebooted remotely, using out-of-band management. Server casings can be flat and wide, and designed to be rack-mounted.

The server system in one embodiment is geographically distributed over a wide area, with many interfaces to internet traffic and multiple storage devices. One or more of the multiple storage devices are configured to contain redundant information System Architecture The overall architecture of the present system involves one or more servers for storing, marketing, and selling songs created by a user. In one embodiment, there is a series of social media servers for marketing the songs, operating one or more of the back end processing for Facebook, Twitter, Instagram, Snapchat, Wechat, Whatsapp, or other applications. Another one or more servers handle the upload of songs from users and the storage of the songs on the server. A third series of servers incorporate the backend of an electronic store front, Each of these servers serve client applications running on smartphones or other computing devices. The clients interact with the servers over the internet.

Figure 2:
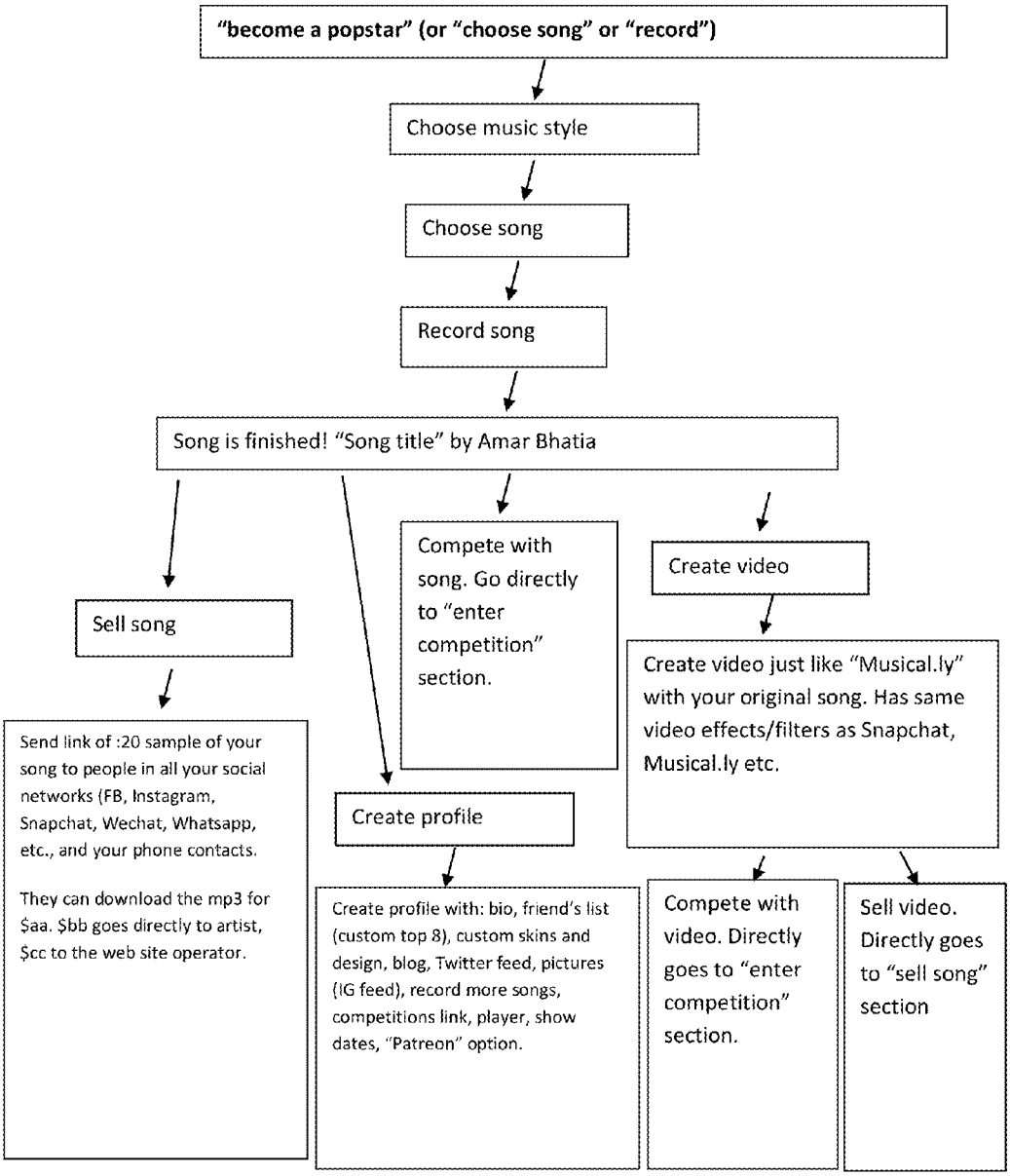
FIG. 2 is a flow chart of the overall architecture of the system.

Looking to FIG. 2, the high level steps that a musician takes to create, market, and sell a musical piece are outlined. First, the musician initiates the app on the smartphone by selecting the app ("become a popstar", for example) 201. When the app 201 begins, the musician is asked to select the music style 202. Once the music style is selected, the musician chooses a song 204 to accompany with the musician's voice or an instrument. The song is one of a library of musical pieces stored on the musical upload server.

Once the song is selected 203, the musician records 204 his voice or instrument in accompaniment to the selected song. The musician starts by causing the recorded song to start playing on the smartphone speakers 115, and then sings into the smartphone microphone 117. In another embodiment, the musician could use headphones 116 to hear the song. In another embodiment, the musician could use an external microphone, perhaps connected through USB or Bluetooth.

When the recording is completed, the musician "finishes" the song 205 by hitting a button on the screen 118 of the smartphone. By finishing the song, the recording and the pre-recorded song undergo a series of processing steps in the central processor 101 of the smartphone. The processing steps include auto tuning, delay, reverb, compression, equalization, and audio quantization. These steps convert the combined recording into a radio quality musical piece. The musician then selects a twenty second snippet of the musical piece to use for marketing.

Both the musical piece and the marketing snippet are then uploaded from the smartphone to the musical upload server. The uploading could be done through the smartphone Bluetooth or WLAN modules 113 or through the cellular connection 102, 103 to the internet to the servers. The musician then has the choice of one or more of steps to market and sell the musical piece.

The first option is to sell the song 206. The musical piece and the marketing snippet is moved to the sales server and offered to the public for purchase 207. In one embodiment, the marketing snippet is sent via social media to the musician's friends and followers. In another embodiment, the musical piece is sold on a web storefront as an mp3 recording, with a portion of the revenue going to the artist, and the other portion going to the storefront operator.

A second option is to enter the musical piece into a competition 210. The musician uploads the entire musical piece or a snippet to the competition server. Various judges or audience members on the Internet listen to the musical piece, and judge it against other musicians who have similarly uploaded music to the competition.

The third option is to create a musicians web page through the entry of a profile 220. The musician enters 221 his biography, list of friends and followers, custom skins, design, links to the musician's blog, links to twitter feeds, pictures, other songs, links to competitions, dates of the musician's shows and performances, and perhaps a "Patreon" link for collecting donations.

"Patreon" allows fans pay to enter a video chat room, and watch a user perform music live. There's a fee to enter the video chat room, and then there's a live video feed of the user. The fans watch him perform live, and can chat with him through live text, and the main user can read what they say and respond back. Basically like webcams but for music. The fans can also donate money to the user at any time. Like a fan can say "will you play this song I really like?" and the user can say "for a donation of $5" and the fan can then donate $5. This will allow other users (fans) to pay to enter a live feed video/webcam room, and watch and interact with a musician's live performance.

The forth option is the creation of a video 230. The user creates a video similar to the Musical.ly app, in combination with the musical piece 231. Filters, lenses and video effects such as those found on Snapchat and Musical.ly are added, and the processing by the CPU 101 synchronizes the video with the musical piece. To create a video, the musician can hit the video record button on their smart phone, and the musical piece will play, and they can record a video of them performing/lip syncing to the song. This music video option will allow for editing, filters to be added, video effects to be added. The app Musical.ly currently does this where users can create their own music videos with many cool filters and effects features, but they're only able to do it lip syncing to cover songs, like a Taylor Swift song. Through the current app, the musician would be making original music videos, to their original songs. They can then enter the competition section with their music video, and compete with the music video.

The musician can then enter the video into a competition 232 similar to the competition described in 210. Or the musician can sell the video 233 as in steps 206 and 207.

Figure 3:
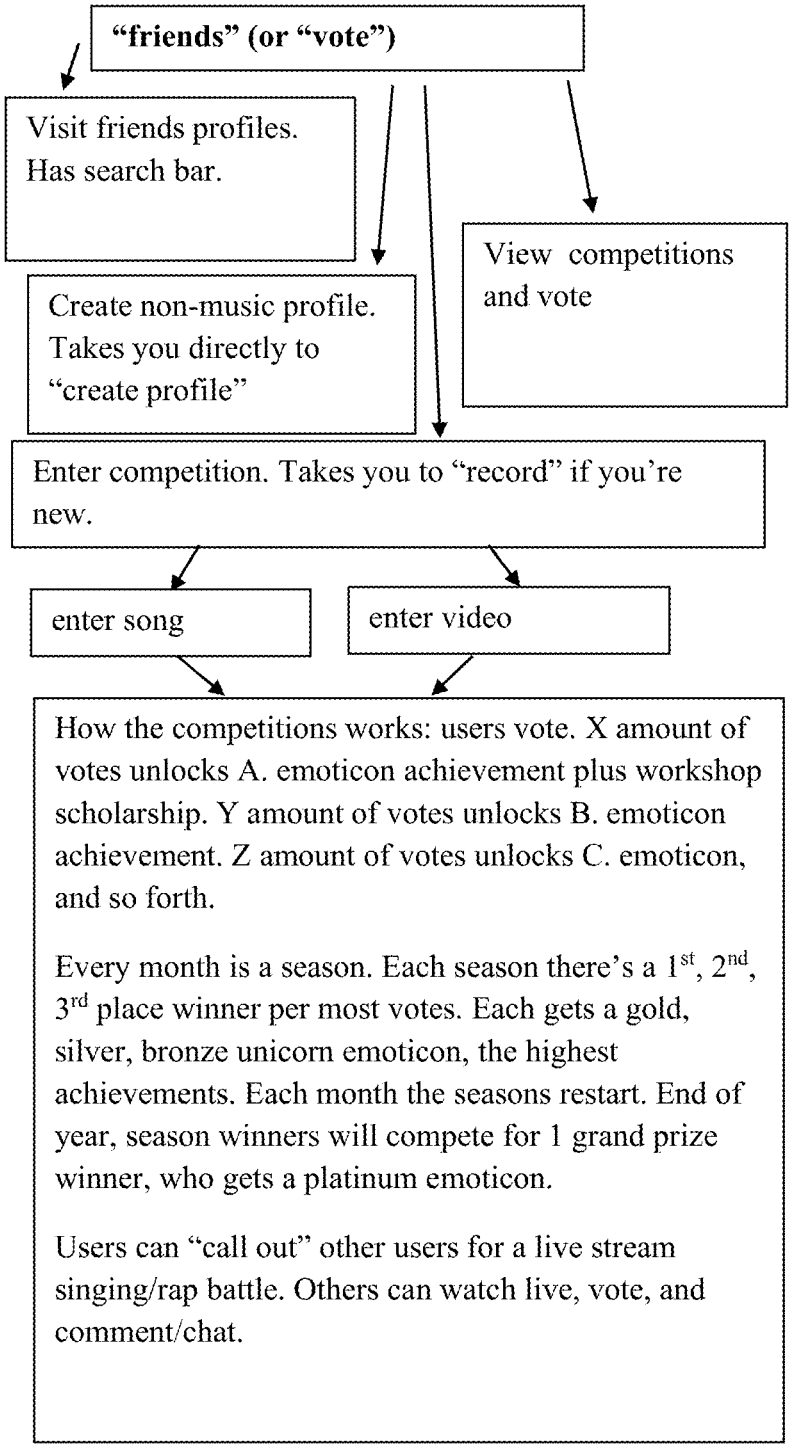
FIG. 3 is a flow chart of the architecture of the competition feature of the system.

FIG. 3 shows the structure of the competition portion of the current system. When a user selects a "vote" or "friends" button in the user interface of the app on the smartphone 301, the user is presented with four options. The user can select one of more of these options.

One option shows links to the profiles of other users 302. This option could also include a search feature and/or an index list. It could also include icons highlighting recently changed profiles. If a user selects a link, the user interface displays the profile at the selected link.

Another option is to create a profile for the user. This option creates a web page for the user through the entry of a profile 310. The steps could be the same as is FIG. 2 at 220. The user enters 221 his biography, list of friends and followers, custom skins, design, links to the user's blog, links to twitter feeds, pictures, other songs, links to competitions, dates of shows and performances that the user is interested in.

The third option allows the user to enter a competition 320. This option is similar to option 210 in FIG. 2. The user could enter a song 321 or enter a video 322. In one embodiment, the user's musical piece is judged in the competition 323. After receiving a certain number of votes, the song is awarded an emoticon, such as a red ribbon. After a certain additional votes, the song is given a blue ribbon emoticon, and perhaps a scholarship to a workshop. Emoticons could also be awarded to the artist's profile showing his achievement.

At the end of the competition, the user and the song that gets first, second or third based on the number of votes could get special emoticons, perhaps a gold, silver, and bronze unicorn emoticon. Additional prizes could be awarded for those who receive the top vote counts for the year.

In another embodiment, users can "call out" other users for a live stream singing or rap battle. One competitor could "call out" another competitor to do a live feed singing battle. If both users agree, they'll enter a split screen live video room. Users/fans can watch a live feed of the two competitors competing against each other. The fans can interact with them live through text chatting, and at the end of a certain time limit, the users/fans vote to see who they liked most. The winner will then bump ahead of their competitor if their competitor was in front of them in the competition. The performance could be recorded and stored for future voting.

The final option is to view competitions 330. In this option, the user is presented with a list of open competitions. This may be in the form of an index listing the competitions, or may allow search through the competitions. The index may be sorted by musical categories, sorted by video or audio, or sorted by the closeness of friends. Icons could be presented on the user interface for popular competitions, or for recently started competitions. In a competition, the user listens, or views, to one or more entries in the competition, and ranks the songs.

Voting could be done using a number of voting algorithms. In one algorithm, each user has one vote per competition, and the musician that receives the most votes wins. In another embodiment, the user ranks the top three (or any other number) of musical pieces with one, two, three, etc. The votes are then counted with the first rating having a higher weight than the second ratings, etc.

In another system, the users vote is weighted higher if he has listened to more musical pieces. For instance, if there are ten songs in the competition, a user who listens to only one song gets one tenth vote, whereas a user who has listened to all ten songs gets a full vote. In another embodiment, the user can only vote if he listens to all songs.

Users could also obtain a weighted voting status based on the number of competitions that they have judged, or based on the resume, or based on how many songs they have uploaded to the site. In another embodiment, users who have purchased songs from the site are given a high weight in their votes.

Voting could also involve run-off competitions amongst the top candidates. Voting could continue until a set number of votes are received or for a fixed amount of time. Voters could be required to pay a fee to vote and could vote an unlimited number of times, or could be restricted to voting once.

Figure 4:
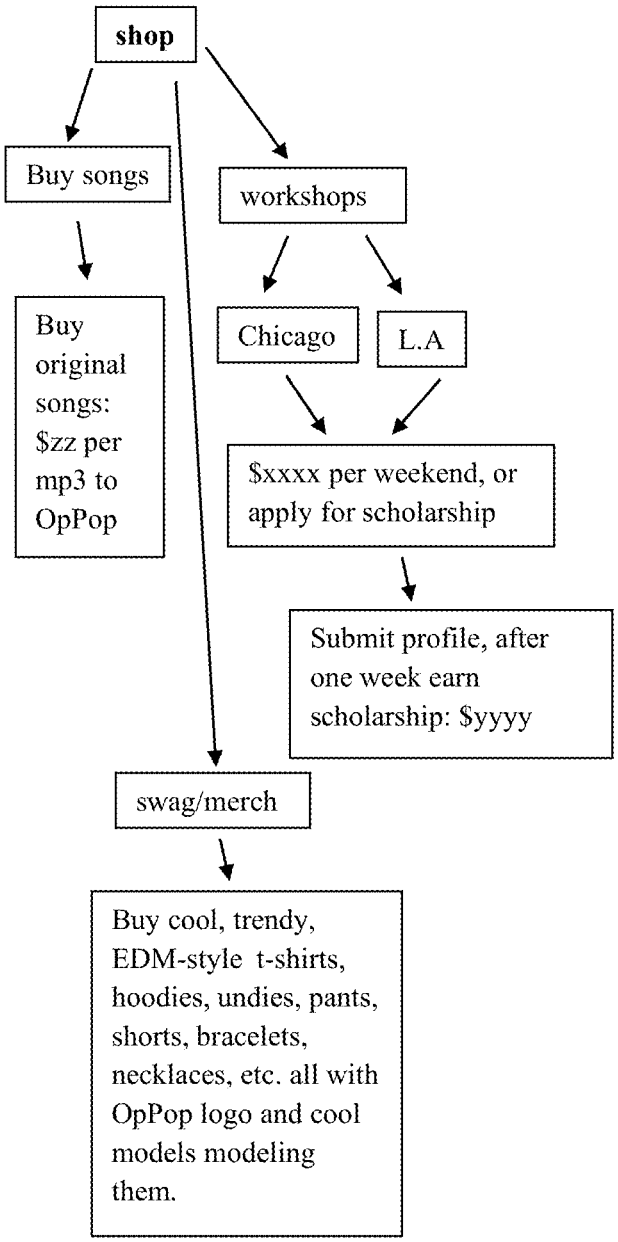
FIG. 4 is a flow chart showing the architecture of the storefront process.

FIG. 4 shows the structure of the store front for the app on the smartphone. The storefront allows the purchase of one or more of songs 402, merchandise 410, and workshops 420.

When purchasing songs 402, the user searches through list of available songs for the song and musician, and selects the song for purchase. The song is then delivered to the user as an MP3 file. In some embodiments the song link is first placed in a virtual shopping cart for combination with other items for purchase. In another embodiment the song is purchased directly. The user may setup a method for payment to automatically use, or the site may require a credit card (or other form of payment) for each purchase. On purchase, the money collected goes to the site operator where a portion may be distributed to the musician (or multiple musicians) and or the song writer. Payment may be direct deposited into the musician's (or songwriter's) account.

If the user desires to purchase merchandise 410, the virtual storefront will allow the selection of t-shirts, hoodies, pants, shorts, hats, bracelets, necklaces, posters, and other related items. In addition, audio equipment such as microphones and headphones could be sold in the store. This goes through the same process as in 402, 403, but will also require the user to specify how and where to ship the items 411.

In addition, the merchandise storefront may include facilities for creating custom merchandise based on logo, artwork, or text for specific musicians. For instance, a specific musician could include a logo or artwork on his profile. A fan could then order a hat with that logo custom embroidered on the hat based on the selection of a certain style and color of the hat, with the designation of the placement of the logo on the hat.

The storefront may also be used to order workshops for musicians to improve their skills 420. In ordering a workshop, the user selects the locations, Chicago 421*a* of Los Angeles 421*b*. Then the user selects the date and subject of the workshop, and either pays for the workshop or applies for a scholarship 422. Given the user's profile, the user may be entitled to a scholarship 423. Scholarship selection may be based on musical ability shown in musical pieces submitted on the website, or on the amount of activity on the site, or other criteria.

User Interface

The user interface is comprised of a number of screens, some of which are described in the figures and the text below.

FIG. 5 shows the features of the user login page. The sign in screen will allow the user to login using their Facebook, Snapchat, Twitter, or other social media account. Otherwise the user may login using an email address or a specific handle used with this smartphone app. If the user is new to the app, the user may be directed to another screen to enter his name, age, and handle. In some embodiments, payment methods and shipping information are also requested. In the background of this screen are videos of songs in the library of musical pieces. Users who login with a social media account, the user's friends are imported automatically and the users profile may also be automatically populated.

FIG. 6 shows the features in the user interface to choose a song style. The selection of song style may be one of EDM music, dance music, pop music, indie music, rap, country music, garage rock, oldies, and other genres. From this screen, the user can select the recording path, a competition path, or a listen option. If the user chooses the competition path, the user is taken to a separate screen that lists the various competitions to listen to and judge. If the user chooses to listen, then they are taken to the storefront to purchase music (or to listen to music already purchased). The background of the song style screen may be videos of songs.

If the user chooses to record music, the user is taken to a selection list to choose a song, as seen in FIG. 7. The user is presented with a list of songs within the selected genre to use. The screen background may be a picture of a recording studio. The user may also be prompted to describe which tracks to use. For instance, if the user is going to sing, then the vocal track will be excluded from the selected song and only the instrumental tracks used for the recording. Background signing may be left in or removed.

The user can then prepare to record the song, as seen in FIG. 8. The screen will offer the user options to play the song, rewind, fast forward, using swiping to the left and right to rewind or forward, in some embodiments. While the song plays, the lyrics are displayed on the screen for the musician to read. In one embodiment, the musician is able to edit the song, removing tracks and changing parts around. For instance, the user may want to run through the chorus twice at the end of the song, so the interface allows for the selection, copying and movement of segments of the song. This screen is essentially designed to help the musician learn the song. The screen will also have a record button to start recording of the musician's voice (or instrument). The user could listen on the smartphone speakers 115, through headphones 116, through Bluetooth speakers, or through a sound system connected to the headphone jack (or through other embodiments).

Once the musician has learned the song, it is time to record, as seen in FIG. 9. The musician follows the same steps as in FIG. 8, except that the song is recorded live. Features may include pausing the recording, muting the microphone, fast forwarding, re-recording, and rewinding. Once again, the text scrolls across the screen to help the musician to remember the words. The recording could be done using the built in microphone 117 or an external microphone. At the bottom of the screen is a "Finish" button.

As shown in FIG. 10, when the user hits the finish button, a number of steps are executed. First of all, the recording is saved, possibly as a separate track. The newly recorded track is then mixed with the previously recorded tracks of the song. Using preset settings, the song is next processed through auto-tuning, delay, reverb, equalization, compression, and audio quantization algorithms. In one embodiment, all of these algorithms run in parallel on the processor 101, perhaps on separate processing cores or as separate processes. In some embodiments, the digital signal processing available in the audio chip 108 could be used to assist in the computational load. The Audio codec 108 architecture may include sample rate converters and a parametric equalizer to process the digital audio data, offloading the CPU 101. The digital mixer in the audio codec 108 may be used to mix the tracks, or the mixing could be done in the CPU 101. In some audio codecs, digital signal processing and fast Fourier transformation functionality is available to the CPU 101 for offloading processing from the CPU.

A separate screen may be available to adjust the settings for each of these functions, so that the musician can fine tune the processing of the musical piece. This could all be done based on the "Finish" button, or it could be a separate screen. In one embodiment, the musician adjusts a single parameter that adjusts the overall fidelity of the recording to the written musical score. At maximum fidelity, the musical piece will be exact, succinct, and precise. At the other end of the spectrum, the fidelity will be sloppy and expressive of the musician without the electronic manipulations. This fidelity adjustment could be set for the entire musical piece, of could be set for segments of the song.

Using the information from the written music score that was used by the musician during the recording, the app will extract parameters for use by the various processing algorithms. Each component of the super plug in (each individual plug-in) will be pre-set per song from these parameters. In addition, the pre-recorded instrument tracks will contain information used in the processing of those tracks that can be used to coordinate the processing and mixing of the combined musical piece. Using this information, combined with the musician's fidelity parameter, specific parameters are set for each algorithm. For example:

auto-tune: if the song is in C Major, the auto-tune's parameters will be preset so that the notes of all recorded vocals will be placed in the scale of C Major. In one embodiment, the auto-tune and audio quantization parameters can be combined in that the notes are placed on the same grid: the up and down lateral movement being the pitches of the melody, the left and right horizontal movement being the rhythm of the melody.

audio quantization: if the song's tempo is bpm 100, the notes of all rhythms recorded will be placed in the tempo of 100 bpm, and all fractions of that tempo. For example: quarter notes will equal 100 bpms, eighth notes will equal 1,000 bpms, sixteenth notes will equal 10,000 bpms. It will all be placed on the quarter note grid for 100 bpm.

Figure 13A:
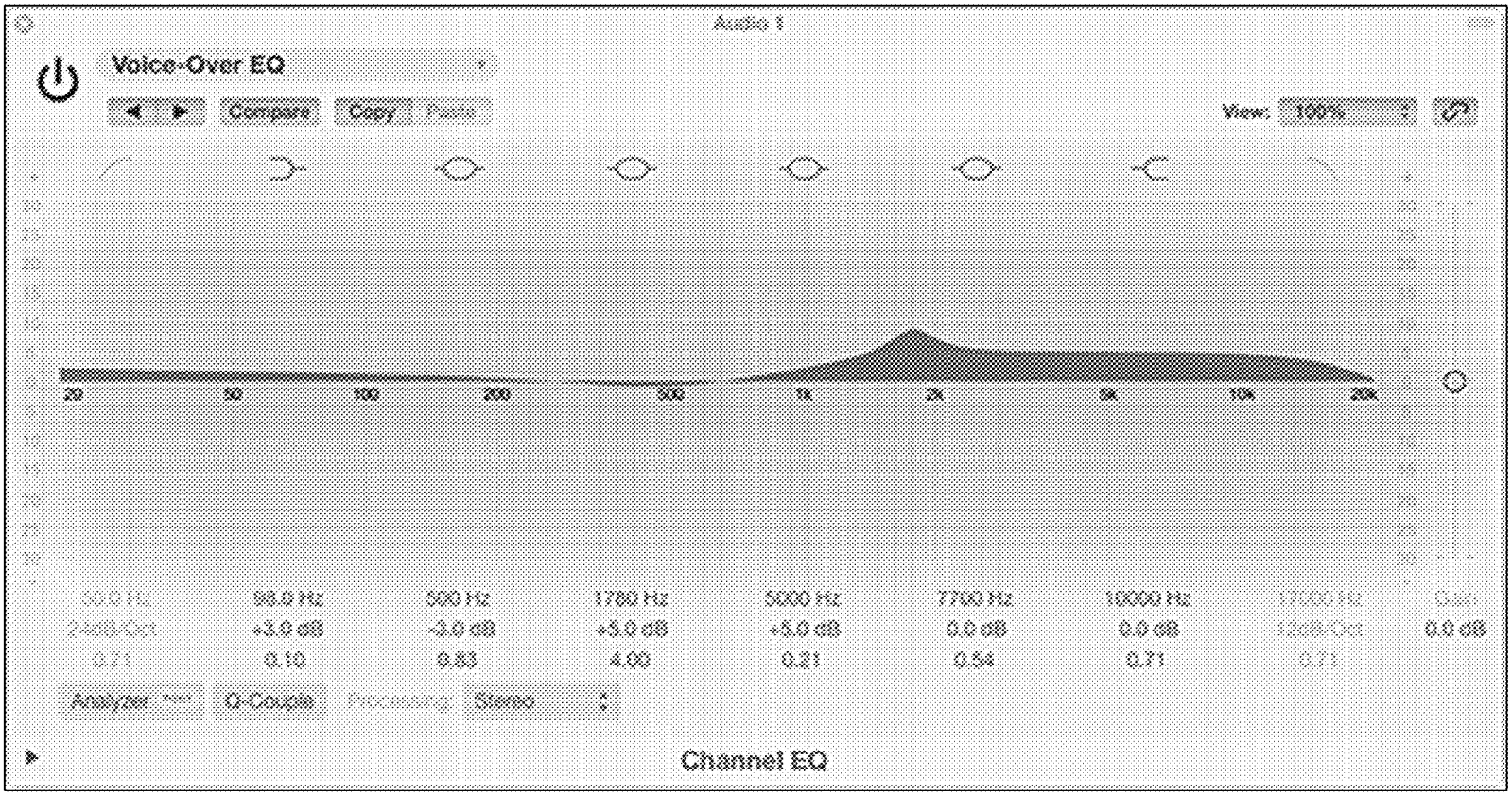
FIG. 13*a* is a typical equalizer chart of a female voice.
Figure 13B:
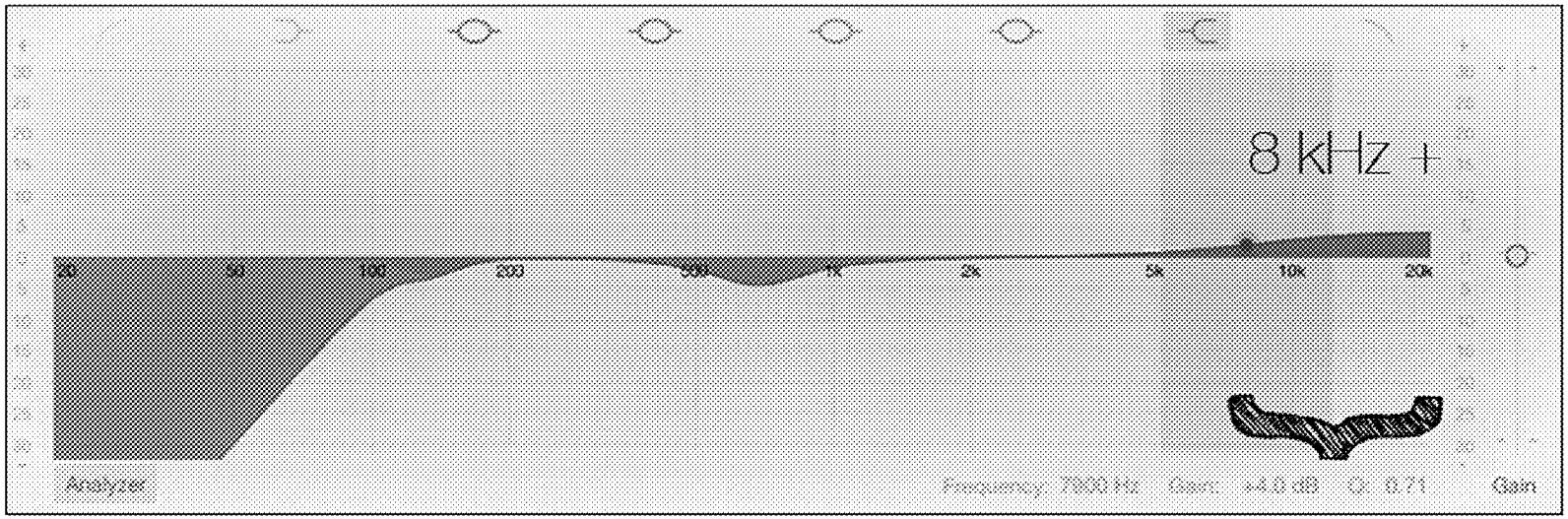
FIG. 13*b* is a typical equalizer chart of a male voice.
Figure 13C:
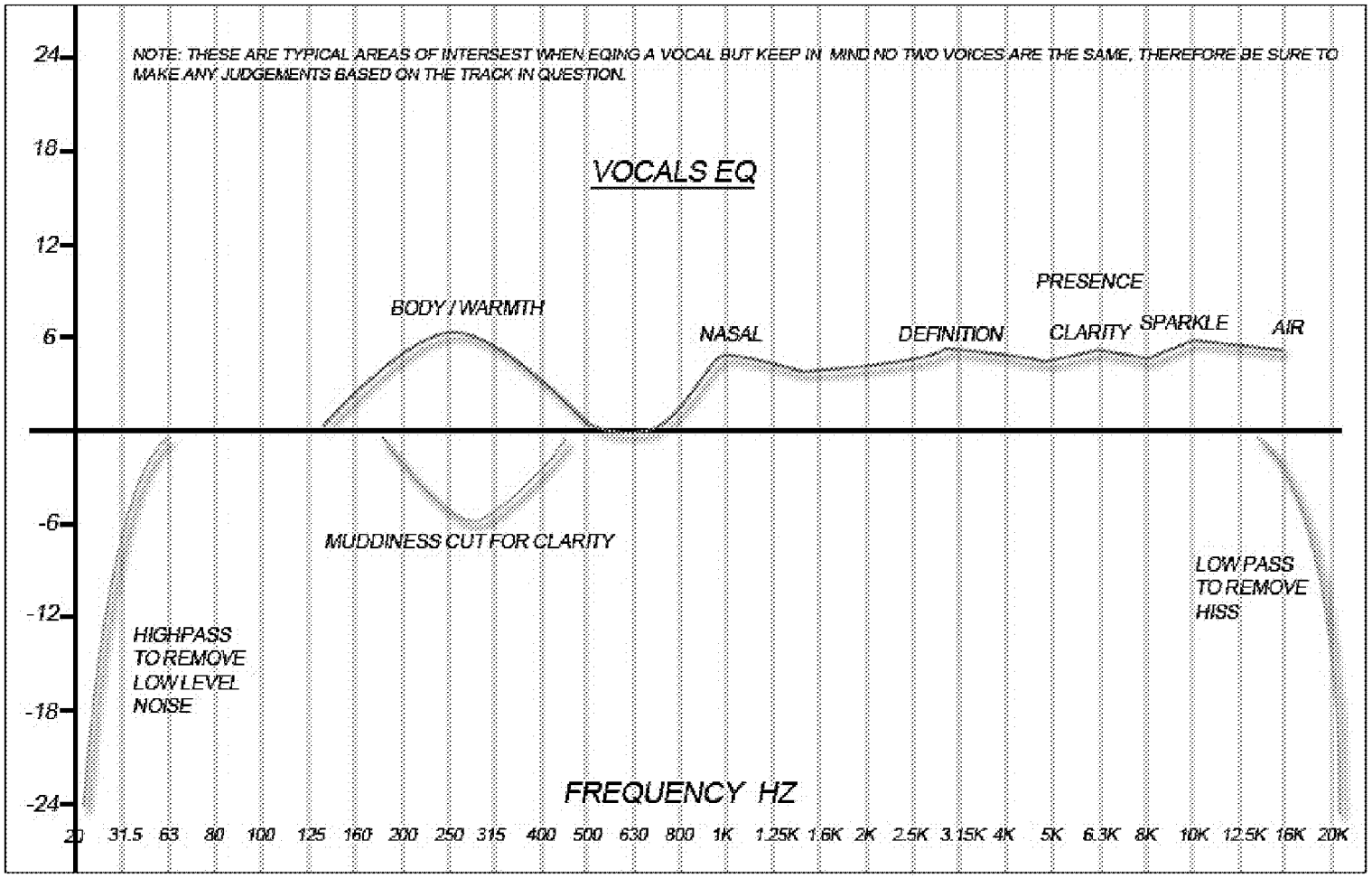
FIG. 13*c* is a chart of typical equalizer settings for vocals.
Figure 13D:
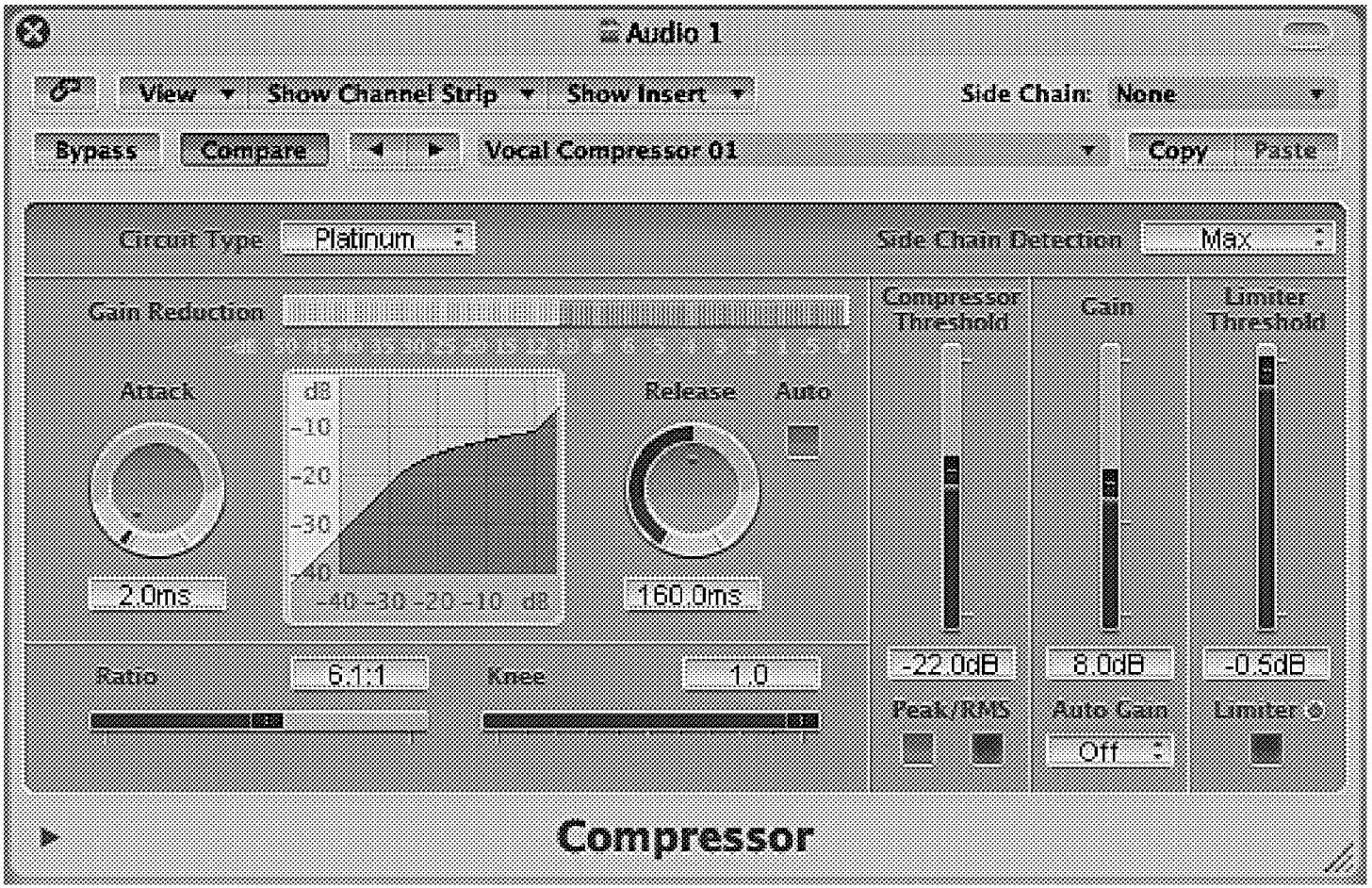
FIG. 13*d* is a screen shot of the compressor settings for vocals.

EQ: if the singer is a male, his EQ will be preset so the low end will largely be taken out, and the high end will slightly be boosted. This is a standard preset for male vocals. Females will have standard preset EQ also. See FIG. 13*a*, FIG. 13*b* and FIG. 13*c*.

reverb/delay: The reverb/delay plugin will be preset based on the tempo of the song. So, if the tempo of the song is 100 bpm, the timing of the delay will be based on 100 bpm. If the song's mix indicates that the vocals should have a delay set to quarter notes, with a long decay, then the reverb/delay plug-in will be preset for that song to always be bpm 100 quarter notes, with a long decay.

compression: The compression plugin will be preset so the attack, threshold, gain, and release settings will all be preset based on what is needed per song. See FIG. 13*d* for a display of standard preset plug-in for vocal compression.

The next screen, described in FIG. 11, presents the finished song to the musician. He can return to the Record screen to re-record if necessary, or to the settings screen to adjust the mixing of the music. The screen could have a background of a cheering crowd.

The musician now has the option of selling the song, competing with the song in a musical competition, making a video, competing with the musical video, or shopping for various items.

If the musician decides to sell the musical piece, then, as seen in FIG. 12, the musician can create a short (20-30 seconds) mp3 snippet of the song to use for marketing. The musician could share this snippet with friends and fans on social media such as Facebook, Snapchat, Instagram, WeChat, Twich, Whatsapp, Twitter, Pinterest, Periscope, Line, etc. When sold, the musician will get a portion of the revenue received.

The foregoing devices and operations, including their implementation, will be familiar to, and understood by, those having ordinary skill in the art.

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

The invention claimed is:

1. An apparatus for self-producing musical piece, the apparatus comprising:

a microphone;

an audio signal device;

an audio codec, electronically connected to a microphone and an audio signal device, where in the audio codec is configured to transmit first audio signals to the audio signal device and to receive second audio signals from the microphone;

a memory for storing data and digital representations of the first and the second audio signals;

a network communications device that includes a cellular network interface, wherein the network communications device transmits and receives data, including the digital representation of the first audio signals, from a wireless network;

a central processing device, electrically connected to the memory, the audio codec, and the network communications device, wherein the central processing device transmits the digital representations of the first audio signals to the audio codec and receives the digital representation of the second audio signals from the audio codec, and combines the first and the second audio signals into a third audio signals by executing, in parallel, algorithms to mix, auto-tune, equalize, compress and audio quantize the first and the second audio signals using preset parameters, wherein the third audio signal is stored in the memory and wherein the third audio signals are incorporated into the musical piece, wherein the audio quantization corrects rhythm.

2. The apparatus of claim 1 wherein the audio signal device is a headphone.

3. The apparatus of claim 1 wherein the audio signal device is a speaker.

4. The apparatus of claim 1 wherein the third audio signal is transmitted to the wireless network through the network communications device.

5. The apparatus of claim 1 wherein the preset parameters include a fidelity parameter that is used by a plurality of the algorithms.

6. The apparatus of claim 1 wherein the central processing device comprise a plurality of processing cores.

7. The apparatus of claim 6 wherein the parallel execution of the algorithms is performed by the plurality of processing cores.

8. The apparatus of claim 1 wherein the parallel execution of the algorithms is performed as different processes on a single core of the central processing device.

9. The apparatus of claim 1 wherein a portion of the processing of the algorithms is executed within the audio codec.

10. The apparatus of claim 1 wherein the first audio signal comprises a plurality of tracks of a song.

11. A method for self-producing a musical piece, the method comprising:

receiving, in a memory attached to a central processing device, a first audio signal from a wireless network through a network communications interface;

transmitting, from the memory, the first audio signal through an audio codec to an audio signal device;

receiving, at the audio codec, a second audio signal from a microphone;

storing the second audio signal into the memory;

mixing, by the central processing device, the first and the second audio signals into a third audio signal;

auto-tuning, by the central processing device, the first and the second audio signal as it is being mixed into the third audio signal;

equalizing, by the central processing device, the first and the second audio signal as it is being mixed into the third audio signal;

compressing, by the central processing device, the first and the second audio signal as it is being mixed into the third audio signal;

audio quantizing, by the central processing device, the first and the second audio signal as it is being mixed into the third audio signal, wherein the audio quantizing corrects rhythm, wherein the mixing, auto-tuning, equalizing, compressing and audio quantizing are processed by the central processing device in parallel using pre-set parameters; and storing the third audio signal into the memory, wherein the third audio signals are incorporated into the musical piece.

12. The method of claim 10 wherein the audio signal device is a headphone.

13. The method of claim 10 further comprising transmitting the third audio signal through the network communications interface to the wireless network.

14. The method of claim 10 wherein the preset parameters include a fidelity parameter.

15. The method of claim 10 wherein the central processing device comprises a plurality of processing cores.

16. The method of claim 15 wherein the parallel processing of the central processing device is performed by a plurality of processing cores.

17. The method of claim 10 wherein the parallel processing of the central processing device is performed as different processes on a single processing core of the central processing device.

18. The method of claim 10 wherein a portion of the parallel processing is performed by the audio codec.

19. The method of claim 10 wherein the first audio signal comprises a plurality of tracks of a song.

20. The method of claim 10 wherein reverb and delay are added to the third audio signal as the third audio signal is being mixed.

* * * * *